US006338310B1

(12) United States Patent
Koizumi

(10) Patent No.: US 6,338,310 B1
(45) Date of Patent: Jan. 15, 2002

(54) CONTROL CONSOLE AND SEATING ARRANGEMENT FOR MOTORIZED WATERCRAFT

(76) Inventor: Marvin Koizumi, 140 Huntcroft Way N.E., Calgary, Alberta (CA), T2E 4E5

( * ) Notice: Subject to any disclaimer, the term of this patent is extended or adjusted under 35 U.S.C. 154(b) by 0 days.

(21) Appl. No.: 09/500,077

(22) Filed: Feb. 8, 2000

(30) Foreign Application Priority Data

Feb. 11, 1999 (CA) ..... 2261461

(51) Int. Cl.[7] ..... B63B 17/00
(52) U.S. Cl. ..... 114/363
(58) Field of Search ..... 114/363; 440/6, 440/7

(56) References Cited

U.S. PATENT DOCUMENTS 5,279,242 A 1/1994 Johnson ..... 114/144
5,372,082 A 12/1994 Hattori ..... 114/144

OTHER PUBLICATIONS

One page advertisement for Lund Mercury Outboards captioned "There are dozens of little reasons why top pros are so successful on the water".
One page advertisement for Evinrude Outboards captioned "It's surprising how fast 15HP can get you away from it all".
Half page advertisement for Yamaha Outboards captioned "The future of fishing naturally".

*Primary Examiner*—S. Joseph Morano
*Assistant Examiner*—Ajay Vasudeva
(74) *Attorney, Agent, or Firm*—Thomas E. Malyszko

(57) ABSTRACT

A novel rotatable seating arrangement for a motorized watercraft has an integral console with instrumentation and watercraft controls thereon to allow the watercraft's operator to control operation of the watercraft from one location, and to perform other functions, such as fishing without obstruction from the console and from the same position while retaining the ability to control the watercraft. The seating arrangement has a generally upright pedestal fixed to the watercraft's deck and a platform pivotally mounted atop the pedestal. A seat is fixed to the platform for supporting the operator in an upright seated position, the seat and platform being rotatable about a longitudinal axis of said pedestal to make available to the operator a 360 degree viewing area while operating the watercraft from the seated position. A locking system on the platform engages the pedestal for controlling rotation of the seat. A control console for carrying watercraft instrumentation and controls is fixed to the rotateable platform adjacent the seat within reach and view of the operator to allow operation of the watercraft while seated. The control console includes a left side portion to the left side of a seated operator and a right side portion to the right side of a seated operator, which side portions are located just above the height of the base of the seat to avoid interfering with the seated operator's use of hand-held equipment. An engine throttle and shift controller is located on the left or right side portion, and a steering controller is located on the other side portion, to allow the operator to operate the watercraft in the seated position regardless of the rotation of the seat.

19 Claims, 5 Drawing Sheets

CONTROL CONSOLE AND SEATING ARRANGEMENT FOR MOTORIZED WATERCRAFT

FIELD OF THE INVENTION

The present invention relates to a motorized watercraft which is an improvement over conventional watercraft having either tiller steering or remote steering arrangements.

BACKGROUND OF THE INVENTION

Most motorized watercraft, particularly those used for sport fishing, have either a tiller steering system or a remote steering wheel system. Both systems have disadvantages and inefficiencies which have not been addressed to date.

A tiller steering system relies on human effort to maintain steering control of a motorized watercraft, or boat. This is done by pushing or pulling on a steering arm which extends into the boat from an outboard motor pivotally connected to the back, or stern, of the boat. The pushing or pulling action on the motor's steering arm pivots the motor and directs the motor's propeller thrust to change the boat's direction of travel. The operator's steering arm also controls the throttle by twisting the wrist, like on a motorcycle.

There are several problems which such conventional tiller steering arrangements. First, any movement of the operator's steering arm to direct the motor's thrust also effects the throttle position, which may not be desired. Simultaneous steering and throttle control can therefore be tricky, and can result in unintended and dangerous manoeuvres. Second, this arrangement typically causes arm strain, particularly on long trips, where an operator is constantly changing throttle position, such as when fishing. Third, the operator's direct contact with engine vibrations can create operator fatigue or numbness. Fourth, to change the transmission between forward and reverse, many tiller systems require an operator to either let go of the steering arm and throttle, or to turn back toward the motor, so that the operator's opposite arm can move a gear shift lever mounted on the engine block. Fifth, the operator's attention must be diverted from the bow of the boat when starting a tiller engine. Sixth, an operator must usually sit at an angle to the motor, and not squarely in his seat. This position is the only way the operator of this type of boat can exert enough arm strength and degree of lateral movement to steer the boat. The operator's free hand must often grasp another part of the boat, such as hand holds if provided, to brace himself to remain in his seat, particularly during high speed manoeuvres or rough water conditions. Hence, the allowable horsepower on tiller type systems must be limited so that the operator can properly and safely control the boat.

Motorized watercraft have evolved to include remote steering locations. In one conventional version the boat will have an operator console on one side, i.e. port (left side looking forward) or starboard (right side), with a steering wheel in a fixed position, an outboard motor at the stern for propulsion, and a key start system similar to an automobile. Remote steering locations are also found on watercraft utilizing an inboard type of engine for propulsion. Remote steering systems use cables, hydraulics, and electrical assists to move the engine's propulsion in a desired manner. Remote steering systems were developed for newer boat designs to provide operator comfort, and to include features such as a windshield, or a sun top, and the like, because the location of the boat operator was not a limiting factor. The remote steering location, with the mechanical advantages of cables, hydraulics and electric assists enabled boat manufacturers to build boat hulls that would utilize larger horsepower engines rated up to 225 h.p., thus enlarging their markets. However, a drawback of such new hulls and stronger engines is that they can not be interchanged with tiller systems because a tiller operator could not control the additional horsepower. The current maximum horsepower offered in a tiller outboard is 100 h.p. Although a console type watercraft can use a greater range of horse power, the console is in a fixed position, which is not always good for boat control.

Conventional remote steering boats suffer from further disadvantages, particularly when used for sport fishing. The wind screen on the steering console interferes with use of a fishing rod, particularly when casting. Hence, a fisherman often moves to another location of the boat when fishing, which location is remote from the console for controlling the boat. Further, the sonar and other equipment designed to locate fish is typically located at the console, and so is out of reach and sight of the fisherman. Even if the fisherman is seated at the console, he is often turned away from the console, making it difficult and inconvenient to view and operate the console equipment.

What is therefore desired is a novel arrangement for motorized watercraft which overcomes the limitations and disadvantages of existing boat arrangements. In particular, the novel arrangement should have certain attributes and allow an operator to do the following:

1) to easily steer a boat without sitting on the edge of the operator's seat and without having to turn from side to side on a seat as required in conventional tiller arrangements;
2) to be able to shift gears without turning back towards the engine to reach for a shift control lever;
3) to operate the throttle without twisting the operator's wrist and without having to maintain physical pressure on the throttle to maintain boat speed;
4) to operate any horsepower engine for which the boat is rated without having to physically absorb the engine's vibration;
5) to start and stop the engine without having to turn back towards the engine;
6) to view all electronic and navigational instrumentation within arm's length;
7) to be able to read and adjust all instrumentation from the operator's seated position;
8) to steer the boat from the operator's seated position on a rotating console, while maintaining the ability to perform all of the above-noted functions;
9) to have a compact instrumentation design, thus increasing the useable space within the boat, and to allow the operator to modify the instrumentation console if needed;
10) to secure the electronic, ignition, throttle, steering and shifting controls under a single small boat enclosure;
11) to have the operator's seat, along with the instrumentation console, placed at any desired location in the boat when manufacturing or renovating the boat;
12) to have the same handling capabilities of a traditional tiller boat with less operator fatigue and greater safety;
13) to be able to install the present console in a tiller type boat, and to customize the console as desired;
14) to safely operate the boat even if physically challenged; and,
15) to have the console set up for either right or left handed operation.

The invention should also allow boat manufacturers to use motors up to a conventional boat hull's maximum rating, without any further modification of the hull or motor design.

SUMMARY OF THE PRESENT INVENTION

In one aspect the invention provides a novel pivotal operator's seat having an integral console with instrumentation and boat controls thereon to allow the operator to control operation of the boat from one location, and to perform other functions, such as fishing, without obstruction from the console and from the same position while retaining the ability to control the boat.

In another aspect the invention provides a seating arrangement for an operator of a motorized watercraft, the watercraft having a deck for supporting said seating arrangement and operator thereon, said seating arrangement comprising: a seat located on said deck for supporting said operator in an upright seated position, said seat being adapted to rotate about a generally vertical axis to allow said seated operator to selectively face any side of said watercraft while operating said watercraft from said seated position; a control console for carrying watercraft instrumentation and controls, said console being located adjacent said seat within reach and view of said operator while in said seated position, and remaining in a fixed position relative to said seat during rotation of said seat to allow said operator to operate said watercraft while fully seated.

In another aspect the invention provides a motorized watercraft having a deck for supporting an operator thereon, said watercraft including a seating arrangement for said operator comprising:

a seat for seating said operator in said watercraft, said seat being pivotally mounted to said deck for allowing said seated operator to rotate about a generally vertical axis;

a control console operatively engaged to said seat for rotation therewith, said console having left and right side portions located to the left and right sides, respectively, of the seated operator for carrying watercraft controls and instrumentation thereon, said left and right side portions being disposed adjacent said seat within reach and view of said seated operator without obstructing the operator's reach over said control console;

an engine throttle controller on one of said left and right side portions for controlling the speed of the watercraft; and a steering controller located on the other one of said left and right side portions so as to allow the operator to steer the watercraft while seated squarely on said seat and regardless of the rotated position of said seat.

In yet another aspect the invention provides a seating arrangement for an operator of a motorized watercraft, said watercraft having a deck for supporting said seating arrangement and operator thereon, said seating arrangement comprising:

a generally upright pedestal fixed to said deck;

a platform pivotally mounted atop said pedestal;

a seat having a base fixed to said platform for receiving and supporting said operator in an upright seated position, said seat and platform being rotatable about a longitudinal axis of said pedestal to make available to said operator a 360 degree viewing area while operating said watercraft from said seated position;

a locking system operatively engaged with said pedestal for allowing the operator to control the rotation of said seat;

a control console for carrying watercraft instrumentation and controls, said console being connected to said platform and disposed adjacent said seat within reach and view of said operator while in said seated position, said console remaining in a fixed position relative to said seat during said rotation of said seat to allow said operator to operate said watercraft while seated;

said control console including a left side portion to the left side of a seated operator, and a right side portion to the right side of a seated operator, wherein said left and right side portions are located just above the height of said seat base so as to avoid interfering with the seated operator's use of hand-held equipment;

an engine throttle and shift controller on one of said left and right side portions, and a steering controller located on the other one of said left and right side portions, thereby allowing the operator to operate the watercraft in said seated position regardless of the rotation of said seat.

BRIEF DESCRIPTION OF THE DRAWING FIGURES

Embodiments of the invention will now be described, by way of example only, with reference to the accompanying drawings, wherein.

LIST OF REFERENCE NUMERALS IN DRAWINGS

Figure 1:
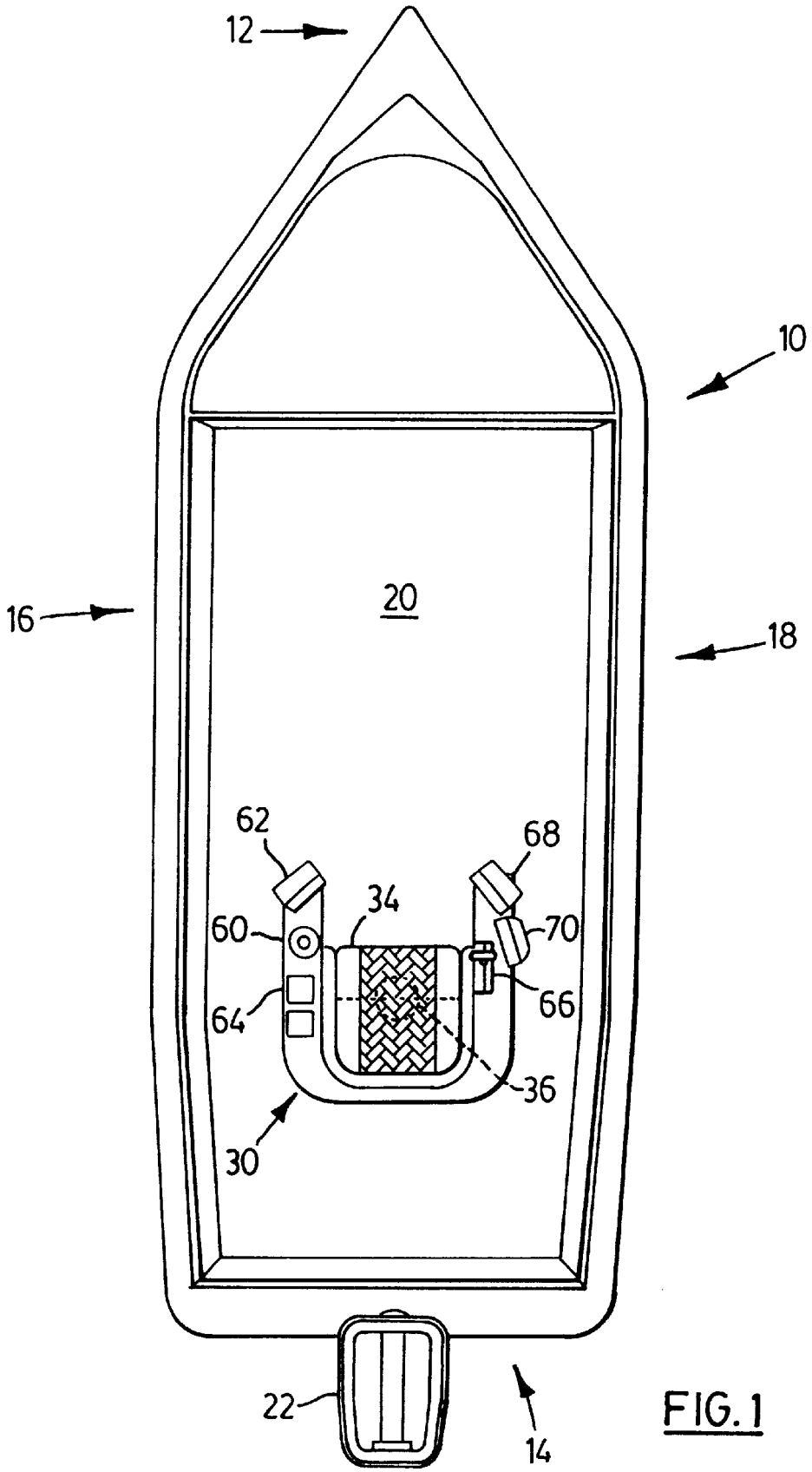
FIG. 1 is a plan view of a seat and control console arrangement mounted on a motorized boat according to one aspect of the present invention, where the seat and console are facing the bow in a standard forward position.

10 boat
12 bow
14 stern
16 port side
18 starboard side
20 deck of 10
22 outboard engine
30 console and seat arrangement
32 bolts
34 seat 35*a,b,c* arm rests; back rest; seat base
36 pedestal
38 platform
39 bolts
40 console
40*a,b* left/right side portions of 40
42 sleeve
44 post
45 plate
46 Teflon bearing pads

48 gusset plates
49 gusset plates
50 hole
52 pin
53 aperture in 52
60 remote steering control
62 bow sonar
64 instrumentation
66 shift controller
68 stern sonar
70 GPS
80 braking system
82 sleeve of 80
84 brake pad
86 lever
87 shaft
88 handle
90 worm gear
92 bushing housing

DESCRIPTION OF PREFERRED EMBODIMENT

The figures show a control console and seating arrangement (generally designated by reference numeral 30) for a motorized watercraft 10. For illustrative purposes and ease of reference, the motorized watercraft will be referred to as a "boat", and in particular one used for sport fishing, such as a bass boat. Hence, a boat operator may also be referred to herein as a "fisherman". It will be understood that the present invention is not limited to use on boats for sport fishing, and may be used on other recreational and commercial watercraft.

Figure 5:
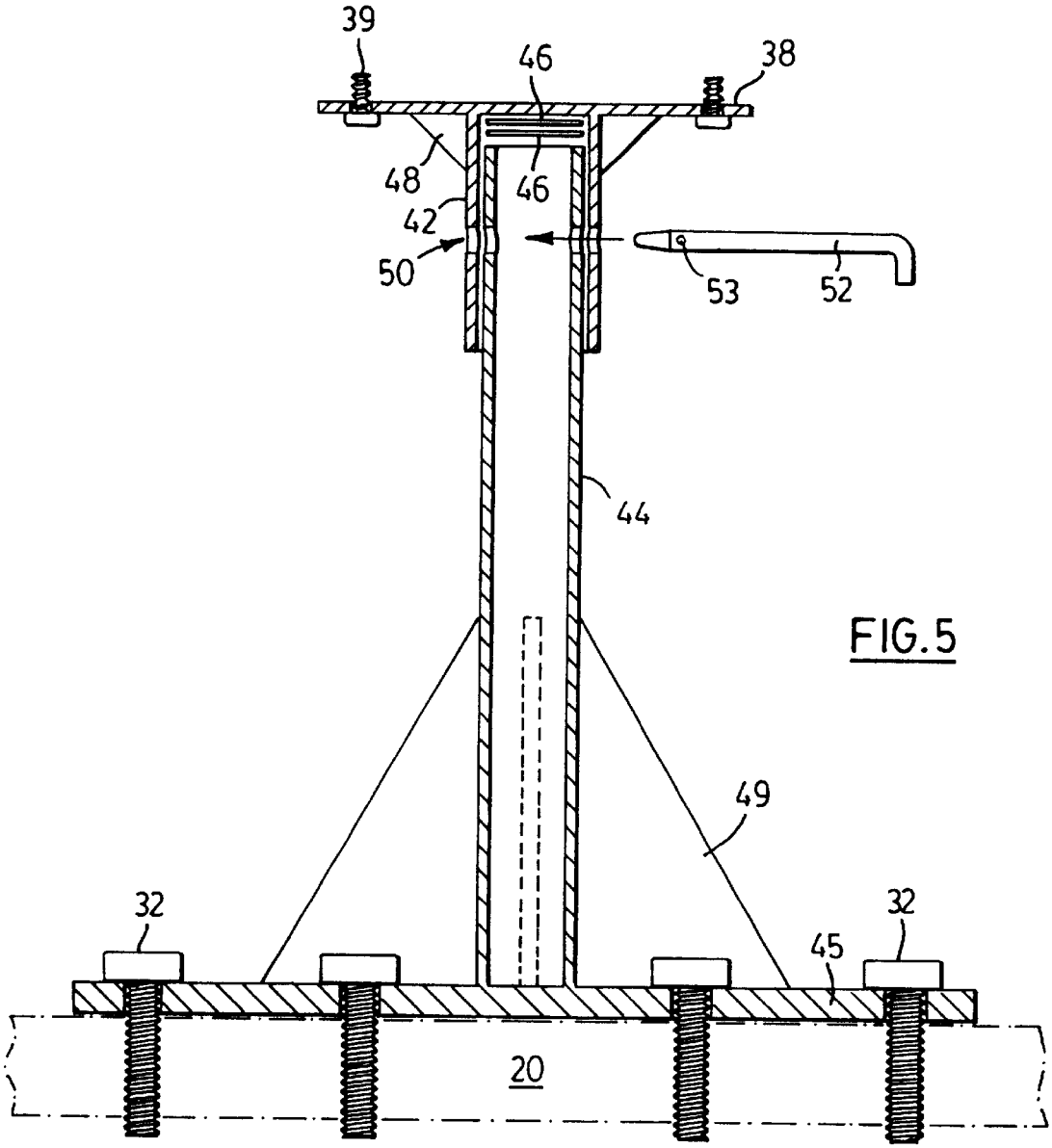
FIG. 5 is a detailed elevational view, partially in section, of one embodiment of a base of the seat and control console of FIG. 4.

The hull of the boat 10 has conventional features such as a bow end 12, a stem end 14, a port side 16, a starboard side 18 and a generally flat base or deck 20. An outboard motor or engine 22 is pivotally mounted to the stem 14, although it will be apparent that the present invention may also be used for other type of engine arrangements, such as inboard engines. The console and seat 30 are mounted onto the deck 20, as by bolts 32 shown in FIG. 5, at any desired location in the boat. The location of the console and seat 30 is not restricted to the stern 14 as with tiller type arrangements. In the FIG. 1 arrangement the seat and console are placed along a longitudinal centerline of the hull for stability when the operator twists the seat and console, and closer to the stem end 14 to provide a better ride and for other known reasons.

Figure 4:
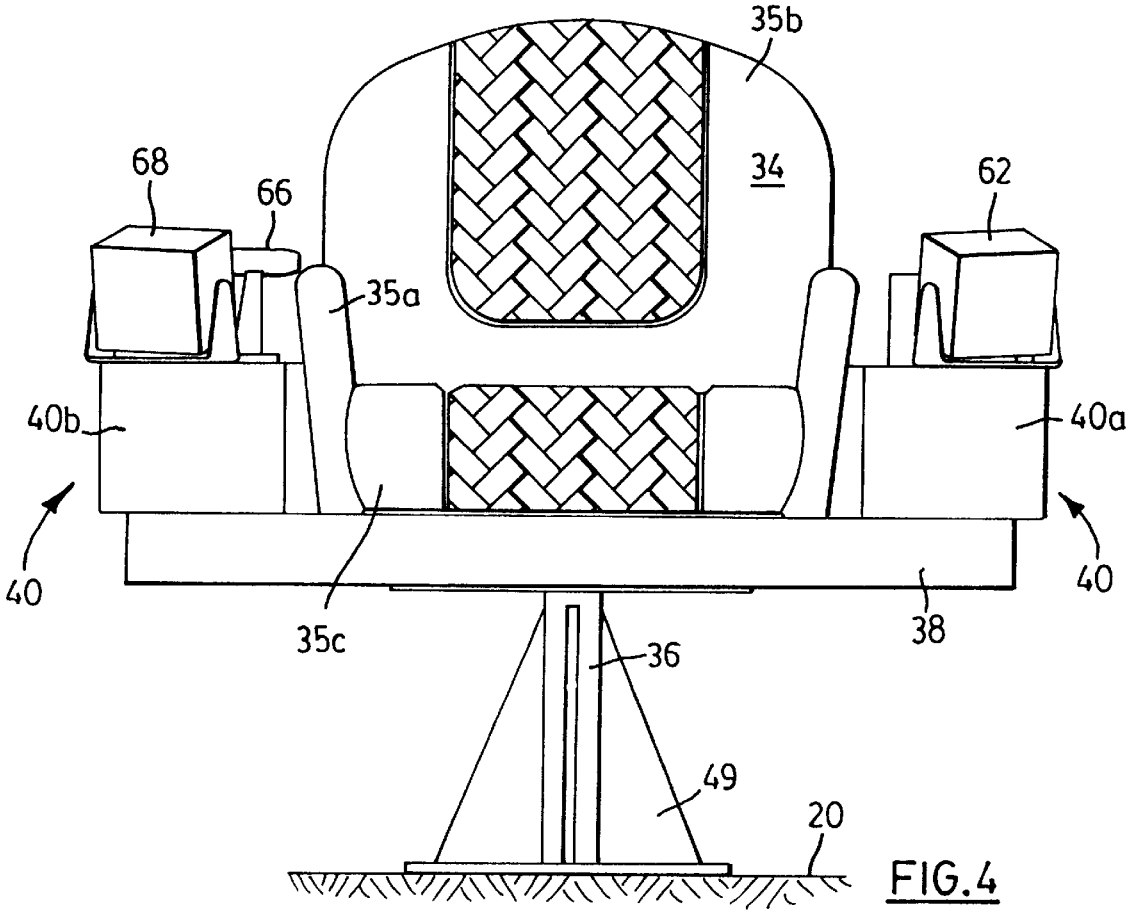
FIG. 4 is an elevated frontal view of the seat and control console arrangement of FIG. 1.

The arrangement 30 of the present invention generally comprises a seat 34 for an operator pivotally mounted on a pedestal 36 (see FIGS. 4 and 5) which is bolted to the boat's deck 20 as noted earlier. The seat 34 has arm rests 35*a*, a back rest 35*b* and a base 35*c* that is fixed to a platform 38 (as by bolts 39 or equivalent means), which platform extends on either lateral side of the seat to form or hold a control console 40. In the embodiment shown in FIG. 5, a hollow sleeve 42 extends below the platform 38 and fits over an upwardly extending post 44 to support the platform a desired height above the deck 20 and to allow the platform to rotate about a vertical axis of the post. One or more Teflon bearing pads 46 are located within the sleeve 42 above the post 44 for ease of rotation. Gusset plates 48 and 49 may be provided as shown to enhance stiffness and stability of the platform to the sleeve and of the post to the plate 45 on the deck, respectively The sleeve 42 and post 44 have an aligned hole 50 passing therethrough adapted to receive a pin 52 to fix the position of the platform 38 relative to the post 44. An aperture 53 near the tip of the pin 52 is provided to accept a cotter pin or like means to secure the pin within the hole 50. A number of these holes 50 may be provided about the post 44 to provide a choice of locked positions.

Figure 6:
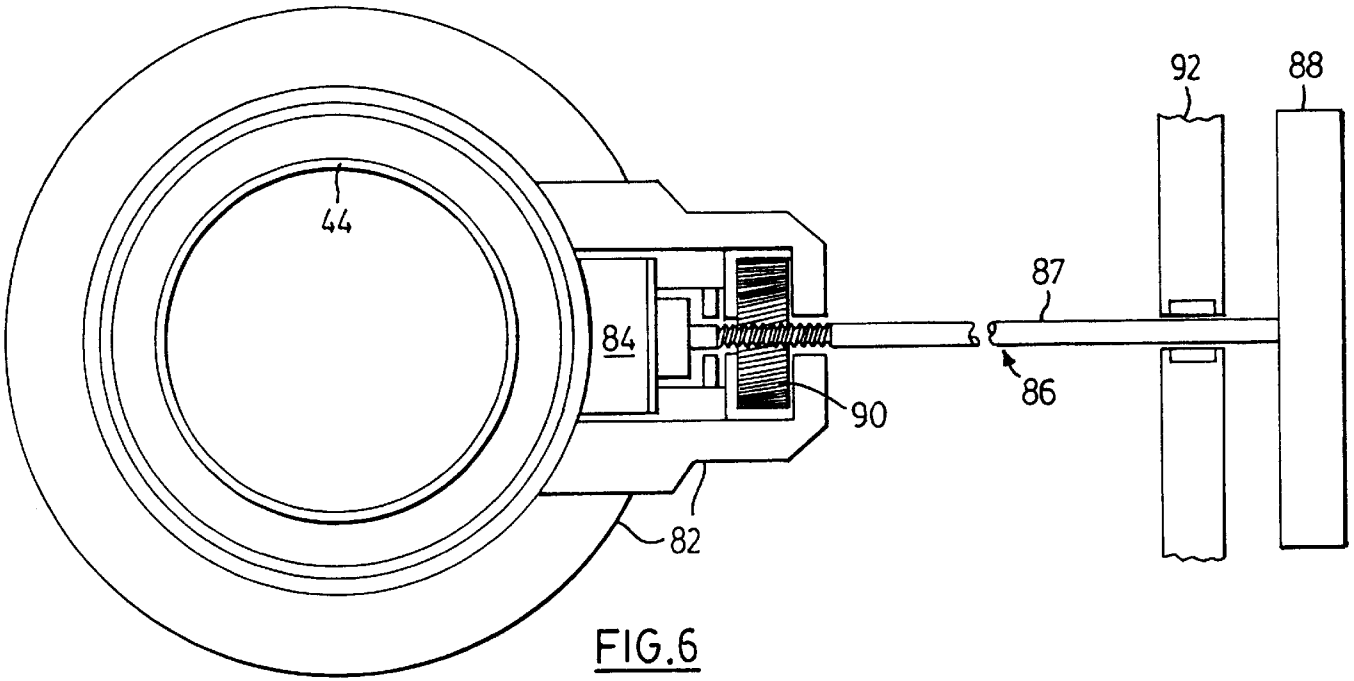
FIG. 6 is a plan view cross-section of a brake assembly for the base of the seat of FIG. 5; and, FIG. 7 shows the location of the brake assembly on the base of the seat.
Figure 7:
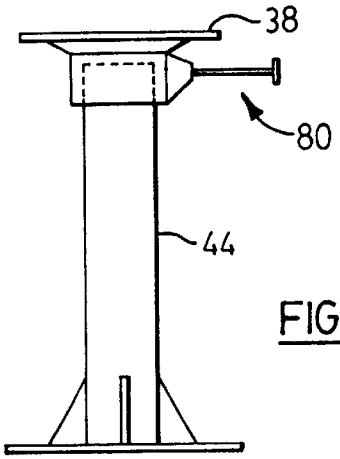

It will be appreciated that another locking means may be provided, either with or instead of the above pin arrangement, such as a braking system 80 with a control lever to provide an infinite number of locked positions for the platform, a preferred embodiment of which is shown in FIG. 6. The braking system 80 is fixed to the seat's platform 38 and extends over a top end of the post 44, as shown in FIG. 7, so that the system rotates with the seat 34. The braking system 80 has a sleeve 82 which surrounds and slidingly engages the post 44. The top end of the sleeve 82 is fixed to the platform 38 so that the sleeve and the rest of the brake assembly rotates with the platform and seat 34. The sleeve 82 houses a brake pad 84 which can slide into and out of contact with the post 44. The pad's contact surface should be contoured to the curvature of the post. The threaded portion of a shaft 87 of a control lever 86 extends through a worm gear assembly 90 fixed to the sleeve 82 for pushing and pulling the brake pad 84 into and out of contact with the post 44. The shaft 87 should be long enough so that a handle 88 extends toward an edge of the platform 38 within comfortable reach of a seated fisherman. A bushing housing 92 fixed to the underside of the platform 38 may be provided to give stability and support to the long shaft 87. In the present embodiment, the handle may be twisted clockwise (when viewed from the outside looking toward the post) to tighten the brake against the post, and thus slow or stop rotation of the seat on the post, and in the opposite direction to loosen or release the brake from the post.

Figure 2:
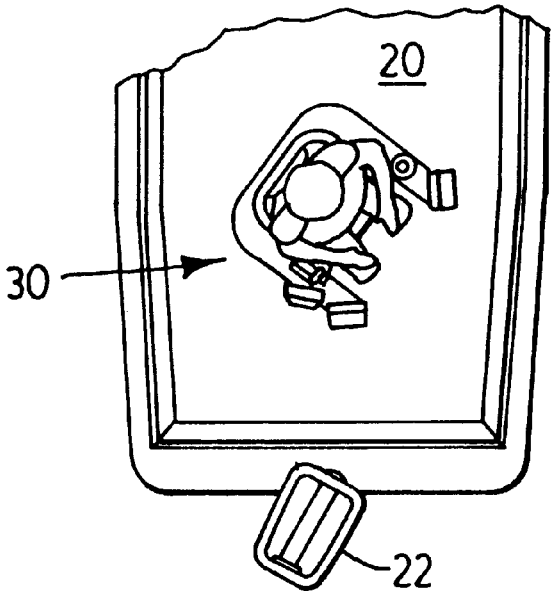
FIG. 2 is a partial view of the boat of FIG. 1 showing an operator seated on the seat and the console pivoted to another desired position.
Figure 3:
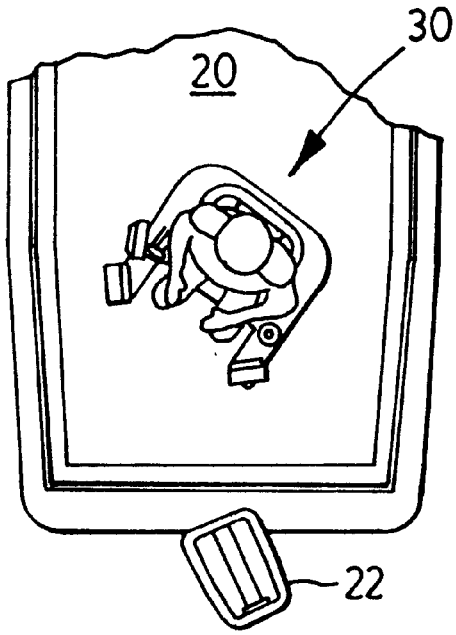
FIG. 3 is a view similar to that of FIG. 2 but showing the operator and console pivoted to yet another desired position.

Another important feature of this invention is the location of the console 40 on either side of the seat 34, as indicated by left and right side portions 40*a*, 40*b*, respectively. The console rotates with the seat, and so the position of the console relative to the seated operator remains the same regardless of how the seat is rotated (see FIGS. 2 and 3). The console may provide the seated operator with additional arm rests for both arms. Most or all of the boat's controls and instrumentation are located on the console within view and easy reach at all times of the seated operator. In the embodiment shown, the left side of the console (as viewed in FIG. 1) has a joy-stick type remote steering controller 60 for the engine 22, a bow sonar 62 at the far end of the console, and additional instrumentation 64 closer in such as indicators for boat speed, trim, battery status, tachometer, fuel gauge, and the like. The right side of the console has sliding shift controller 66 for ignition and throttle control of the engine, a stern sonar 68 at the far end of the console, and a global positioning indicator 70. Other desired instrumentation may be installed as well. It will be appreciated that the location of the instrumentation may be changed, for example the steering controller may be put on the right side of the console and the shift controller 66 on the left side for a right-handed operator. Whatever the position of the controls and instrumentation, it is important they be on the console and within easy reach and view of the operator when seated, regardless of how the operator has rotated the seat. For sport fishing purposes, it is also important that the instrumentation and controls be located on the console so as to minimize or eliminate interference with the fisherman's use of his hand held equipment, such as a fishing rod, while seated. It is also preferred that a windscreen not be located aft of the seat to avoid interference when fishing, although one may be suitably placed for other uses.

The operation and many advantages of the present invention may now be better understood. The invention may be thought of as a "total control concept" for bass fishing boats, and the like. The console/seat arrangement of the present invention allows an operator of the boat to be seated in an ergonomically correct manner the seat 34, while also allowing for a 360 degree viewing area, without his leaving the seated position. The rotating control console provides all the necessary controls to have total control of the watercraft at all times, when under power. There is a manual braking system incorporated for restricting the movement of the platform and console, and a positive pin type locking device to fix the console and seat in one position, if so desired. This concept is a major improvement from conventional fixed position console boat models, and from the angled operator seating position in tiller type boats.

The position of the steering system 60, 66 in the total control concept of the present invention allows the operator to steer the boat, regardless of the position of the operator's seat. This is very important when a boat is being manoeuvred in tight quarters, or in reverse (for example, when docking), or in backtrolling when fishing. Further, by locating the steering arm 60 by the operator but remote from the engine 22, such design should not limit boat manufacturers to lesser horse power offerings for their customers, as is the case with tiller type boats.

In tiller outboard engines throttle control is provided via a cable assembly located at the operator's hand hold position. To activate the throttle, the operator must twist his wrist, towards himself or away, to increase or decease the engine speed. The throttle control on an outboard motor must be controlled at all times by the watercraft operator's steering hand. This can be a very painful experience if one is boating all day, or using the throttle continuously. There are engine throttles as simple as a sliding bar on the front of an engine. Other throttle designs use a cable/twist method on the end of the tiller arm. Still others are designed to be positioned in a remote location. In contrast, the total control concept of the present invention locates the throttle and shift controller 66 at the operator's side at all times while seated. The throttle and steering 60, and all other components that make up the total control concept, are interchangeable between each side of the console and are user friendly. The total control concept has the steering arm 60 on the port side of the console and the throttle/shift lever 66 on the starboard side. This allows the operator to use both hands correctly, and simultaneously. This equipment positioning allows for proper boat control, without compromising safety.

Further, all navigational equipment, sonars and engine instrumentation is mounted on the console within arms length. Hence, all relevant boat information is available to the operator, whenever he is seated at the console. The instrumentation is below eye level, with an unobstructed view. This makes an activity such as fishing a pleasant experience, because the fishing rod is not encumbered by the instruments, throttle or steering. All the instrumentation rotates on the same axis as the steering and throttle, etc., so that the instrumentation and controls are always available to the operator. In contrast, an operator of a tiller boat is bound to one seated position only, if he wants to see all his instruments. An operator of a remote steering boat has a limited view of instrumentation and a less than ideal grasp of controls when he twists on his seat to fish or manoeuvre the boat in reverse or a sideways direction. This is not ergonomically correct nor safe since there are many times when one is manoeuvring the boat in shallow water, or when fishing or docking, that a proper view of vital information from instrumentation is needed without unnecessary delay, The total control concept also incorporates engine ignition, trim and tilt on the rotating console for optimum efficiency.

In sum, an operator of a boat incorporating the present invention will be able to perform all the items mentioned above in total comfort and safety. The total control concept is adaptable for both the novice and the professional boater, and offers more amenities to those who are physically challenged. This concept is adaptable to virtually all watercraft users, and to all boat manufacturers, who wish to improve on their current model designs and sales options. This concept will enable existing watercraft owners to upgrade their boats to this system, with a minimum of cost and effort.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

I claim:

1. A control system for a motorized watercraft comprising a seat assembly and console arrangement for enabling said watercraft to be used with an engine having power up to a design limit for said watercraft, wherein:

said seat assembly is adapted to be rotatably fixed to a deck of said watercraft for supporting an operator of said watercraft in an upright seated position, said seat assembly including a rear portion forming a back-rest, an opposed front leg-engaging portion, and opposed first and second lateral sides between said front and rear portions, said seat assembly including a locking system for allowing the operator to control the rotation of said seat assembly relative to said deck;

said console arrangement having first and second side control portions disposed adjacent said first and second lateral sides, respectively, of said seat assembly to provide said operator with unobstructed frontal entry to said seat assembly, said console arrangement being within reach and view of said operator while in said seated position and at a height relative to said seated operator to avoid interfering with the seated operator's use of hand-held equipment, and remaining in a fixed position relative to said seat assembly during rotation of said seat assembly to allow said operator to hand operate said watercraft while seated; and, an engine throttle and shift controller located on said first side control portion and a steering controller located on said second side control portion to provide the operator hand operated control of the watercraft in said seated position regardless of the rotation of said seat assembly.

2. The control system of claim 1 wherein:

sonar instrumentation is located at a distal end of said second side control portion; and, said steering controller comprises a finger operable joy-stick located intermediate said sonar instrumentation and said back rest.

3. The control system of claim 2 wherein said second side control portion further includes gauges for at least one of the watercraft's speed, trim, battery charge level, tachometer and fuel level, said gauges being located intermediate said joy-stick and said back rest.

4. The control system of claim 3 wherein additional sonar instrumentation is located at a distal end of said first side control portion, and said engine throttle and shift controller is located intermediate said additional sonar instrumentation and said back rest.

5. The control system of claim 4 wherein said first side control portion further includes global positioning instrumentation located adjacent said additional sonar instrumentation.

6. The control system of claim 2 wherein additional sonar instrumentation is located at a distal end of said first side control portion, and said engine throttle and shift controller is located intermediate said additional sonar instrumentation and said back rest.

7. The control system of claim 6 wherein said first side control portion further includes global positioning instrumentation located adjacent said additional sonar instrumentation.

8. The control system of claim 1 wherein sonar instrumentation is located at a distal end of said first side control portion, and said engine throttle and shift controller is located intermediate said sonar instrumentation and said back rest.

9. The control system of claim 8 wherein said first side control portion further includes global positioning instrumentation located adjacent said sonar instrumentation.

10. An assembly for modifying a boat having a tiller operated outboard motor to a boat having a remote console comprising a means for allowing the use of a higher horse power engine on said boat than said tiller possible with operated outboard motor, said means including:

a seat assembly adapted to be rotatably fixed to a deck of said boat for supporting an operator of said boat in an upright seated position, said seat assembly including a rear portion forming a back-rest, an opposed front portion, opposed first and second lateral sides between said front and rear portions, and a locking system for allowing the operator to control the rotation of said seat assembly relative to said deck; and, a console arrangement having first and second control portions disposed adjacent said first and second lateral sides, respectively, of said seat assembly to provide the operator with unimpeded access to said front portion of the seat assembly in a direction generally parallel to said first and second lateral sides, said console arrangement remaining in a fixed position relative to said seat assembly during rotation of said seat assembly to allow said operator to hand operate said boat while seated, and, an engine throttle and shift controller located on said first control portion and a steering controller located on said second control portion to allow the operator to operate the boat while seated regardless of the rotation of said seat assembly.

11. The assembly of claim 10 wherein:

sonar instrumentation is located at a distal end of said second control portion; and, said steering controller comprises a finger operable joy-stick located intermediate said sonar instrumentation and said back rest.

12. The assembly of claim 11 wherein said second control portion further includes gauges for at least one of the watercraft's speed, trim, battery charge level, tachometer and fuel level, said gauges being located intermediate said joy-stick and said back rest.

13. The assembly of claim 12 wherein additional sonar instrumentation is located at a distal end of said first control portion, and said engine throttle and shift controller is located intermediate said additional sonar instrumentation and said back rest.

14. The assembly of claim 13 wherein said first control portion further includes global positioning instrumentation located adjacent said additional sonar instrumentation.

15. The assembly of claim 11 wherein additional sonar instrumentation is located at a distal end of said first control portion, and said engine throttle and shift controller is located intermediate said additional sonar instrumentation and said back rest.

16. The assembly of claim 10 wherein sonar instrumentation is located at a distal end of said first control portion, and said engine throttle and shift controller is located intermediate said sonar instrumentation and said back rest.

17. The assembly of claim 16 herein said first control portion further includes globalpositioning instrumentation located adjacent said sonar instrumentation.

18. A control system for an outboard motor of a boat comprising:

a seat assembly adapted to be rotatably fixed to a deck of said boat for supporting an operator of said boat in an upright seated position, said seat assembly including a rear portion forming a back-rest, an opposed front leg-engaging portion, and opposed first and second lateral sides between said front and rear portions, said seat assembly including a locking system for allowing the operator to control the rotation of said seat assembly relative to said deck;

a console arrangement having first and second side control portions disposed adjacent said first and second lateral sides, respectively, of said seat assembly to provide the operator with unobstructed frontal entry to said seat assembly, said console arrangement being within reach and view of said operator while in said seated position, and remaining in a fixed position relative to said seat assembly during rotation of said seat assembly to allow said operator to hand operate said boat while seated; and, an engine throttle and shift controller located on said first side control portion and a steering controller located on said second side control portion to provide the operator hand operated control of the boat while seated regardless of the rotation of said seat assembly.

19. The control system of claim 18 wherein sonar instrumentation is located at a distal end of said second side control portion; said steering controller comprises a finger operable joy-stick located intermediate said sonar instrumentation and said back rest; and said second side control portion includes gauges for at least one of the boat's speed, trim, battery charge level, tachometer and fuel level, said gauges being located intermediate said joy-stick and said back rest.

* * * * *